US006751967B1

(12) United States Patent
Chen

(10) Patent No.: US 6,751,967 B1
(45) Date of Patent: Jun. 22, 2004

(54) MULTIFUNCTION AIR CONDITIONING DEVICE

(76) Inventor: Chun Hung Chen, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 10/456,152

(22) Filed: Jun. 5, 2003

(51) Int. Cl.[7] ..... F25B 41/04

(52) U.S. Cl. ..... 62/151; 62/196.4; 62/197; 62/93

(58) Field of Search ..... 62/197, 198, 196.4, 62/511, 151, 277, 278, 93, 90

(56) References Cited

U.S. PATENT DOCUMENTS 3,368,364 A * 2/1968 Norton et al. ..... 62/196.4
3,370,438 A * 2/1968 Hopkinson ..... 62/196.4
4,313,313 A * 2/1982 Chrostowski et al. ..... 62/278
4,407,137 A * 10/1983 Hayes, Jr. ..... 62/198
4,716,741 A * 1/1988 Bednarek ..... 62/197
5,088,295 A * 2/1992 Shapiro-Baruch ..... 62/196.4

* cited by examiner

*Primary Examiner*—Harry B. Tanner

(57) ABSTRACT

An air conditioning device includes a compressor coupled between a condenser and an evaporator, a capillary tube device and a valve device are coupled in parallel to each other and coupled between the condenser and the evaporator. Another valve device is coupled between the condenser and the evaporator and in parallel to the parallel capillary tube and the valve device. A further valve and a further capillary tube device are coupled in parallel to the evaporator, and coupled in parallel to each other. The valve devices may be selectively operated and selectively switched off for either air conditioning, or dehumidifying, or drying, or defrosting purposes.

8 Claims, 4 Drawing Sheets

MULTIFUNCTION AIR CONDITIONING DEVICE

BACKGROUND OF THE INVENTION

1. Field of the Invention

The present invention relates to an air conditioning device, and more particularly to a multifunction air conditioning device.

2. Description of the Prior Art

Some of the typical air conditioning devices may be used for both air conditioning purposes and dehumidifying purposes, but may not be used for defrosting purposes.

The other defrosting devices or facilities may be used for defrosting purposes only, but may not be used for air conditioning purposes and dehumidifying purposes.

For allowing the house buildings to be dehumidified and defrosted, two or more kinds of air conditioning devices are required to be purchased and installed within the house buildings, and to dehumidify and to defrost the house buildings.

However, both the typical air conditioning devices and the typical defrosting devices or facilities may all comprise a compressor device, a condenser, and an evaporator, which may not be effectively used for various kinds of or different air conditioning purposes.

The present invention has arisen to mitigate and/or obviate the afore-described disadvantages of the conventional air conditioning devices.

SUMMARY OF THE INVENTION

The primary objective of the present invention is to provide an air conditioning device which may be used for air conditioning purposes and dehumidifying purposes and for defrosting purposes.

In accordance with one aspect of the invention, there is provided an air conditioning device comprising a compressor, a condenser coupled to the compressor, an evaporator coupled to the compressor, and arranged to have the compressor coupled between the condenser and the evaporator, a fan device disposed beside the condenser for blowing air through the condenser, a first capillary tube device coupled between the condenser and the evaporator, a first valve device coupled between the condenser and the evaporator, and arranged in parallel to the first capillary tube, a second valve device coupled between the condenser and the evaporator, and arranged in parallel to the first capillary tube and the first valve device, a second capillary tube device coupled in parallel to the evaporator, and a third valve device coupled in parallel to the evaporator, and coupled in parallel to the second capillary tube device. The third valve device is selectively operated, and the first and the second valve devices are selectively switched off for air conditioning purposes. The second valve device is selectively operated, and the first and the third valve devices are selectively switched off for dehumidifying purposes. The first valve device is selectively operated, and the second and the third valve devices are selectively switched off for drying purposes. The first and the third valve devices are selectively operated, and the second valve device is selectively switched off for defrosting purposes.

The valve devices may be an electromagnetic valve device. The condenser includes an inlet coupled to the compressor, and the evaporator includes an outlet coupled to the compressor, and arranged to have the compressor coupled between the inlet of the condenser and the outlet of the evaporator.

The condenser includes an outlet coupled to the first capillary tube, and the evaporator includes an inlet coupled to the first capillary tube. The condenser includes an outlet coupled to the first valve device, and the evaporator includes an inlet coupled to the first valve device.

The condenser includes a middle portion coupled to the second valve device, and the evaporator includes an inlet coupled to the second valve device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
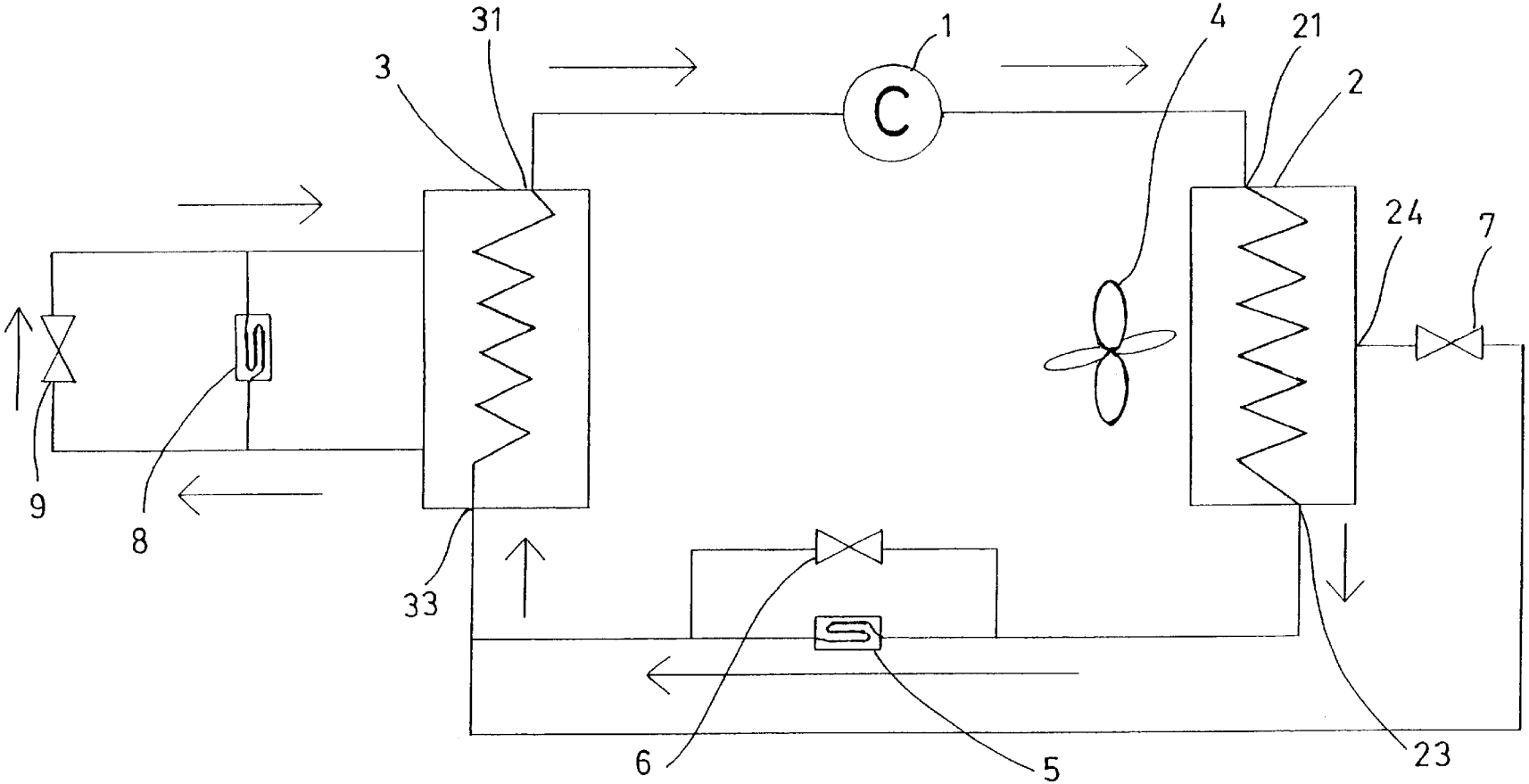
FIG. 1 is a plan schematic view of an air conditioning device in accordance with the present invention, illustrating the air conditioning operation of the air conditioning device.

Referring to the drawings, and initially to FIG. 1, an air conditioning device in accordance with the present invention comprises a compressor 1 coupled between a condenser 2 and an evaporator 3, a fan device 4 disposed beside the condenser 2 for blowing air through the condenser 2.

A capillary tube device 5 and a valve device 6 are coupled or arranged in parallel to each other, and coupled between the condenser 2 and the evaporator 3. Another valve device 7 is also coupled between the condenser 2 and the evaporator 3 and coupled or arranged in parallel to the capillary tube device 5 and the valve device 6.

For example, the compressor 1 is coupled between the inlet 21 of the condenser 2 and the outlet 31 of the evaporator 3, and the capillary tube device 5 and the valve device 6 are coupled between the outlet 23 of the condenser 2 and the inlet 33 of the evaporator 3. The other valve device 7 is coupled between the middle portion 24 of the condenser 2 and the inlet 33 of the evaporator 3.

Another capillary tube device 8 is coupled or arranged in parallel to the evaporator 3, and a further valve device 9 is also coupled or arranged in parallel to the evaporator 3, and coupled or arranged in parallel to the capillary tube device 8.

The valve devices 6, 7, 9, such as the electromagnetic valve devices 6, 7, 9 are used for controlling the flowing of heat or cold media between the compressor 1, the condenser 2, the evaporator 3 and the capillary tube devices 5, 8, and the compressor 1 is used for pumping the heat or cold media through the condenser 2, the evaporator 3, the capillary tube devices 5, 8, and the valve devices 6, 7, 9.

In operation, as shown in FIG. 1, when only the valve device 9 is actuated or energized or operated, and when the other two valve devices 6, 7 are closed or switched off, the heat or cold media may be pumped by the compressor 1, through the condenser 2 and the capillary tube device 5 and through the evaporator 3. The fan device 4 is operated under normal or ordinary rotational speed, at this moment, for example.

Due to the operating of the valve device 9, the heat or cold media may be caused to flow through the valve device 9, and then flow back to the evaporator 3 before flowing back to the compressor 1, at this moment, as shown in FIG. 1. The heat or cold media may be caused to flow through the condenser 2 in lower temperature, and the fan device 4 may blow air through the condenser 2, in order to generate cold air to cool the house buildings.

Figure 2:
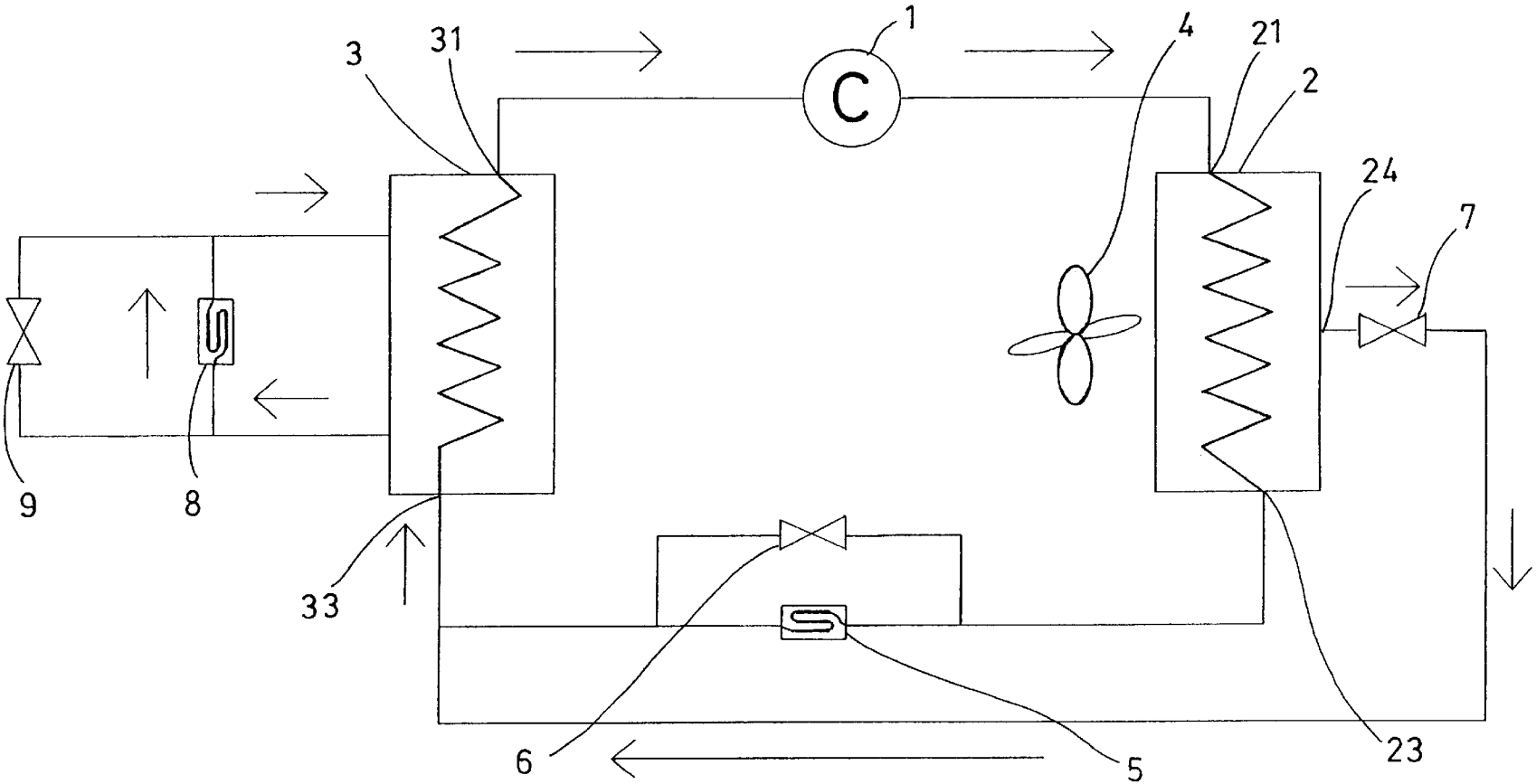
FIG. 2 is a plan schematic view similar to FIG. 1, illustrating the dehumidifying operation of the air conditioning device.

As shown in FIG. 2, when only the valve device 7 is actuated or energized or operated, and when the other two valve devices 6, 9 are closed or switched off, the heat or cold media may be pumped by the compressor 1, through the valve device 7 and through the evaporator 3, and may also be pumped through the capillary tube device 8, for dehumidifying purposes. The fan device 4 is also operated under normal or ordinary rotational speed, at this moment.

Figure 3:
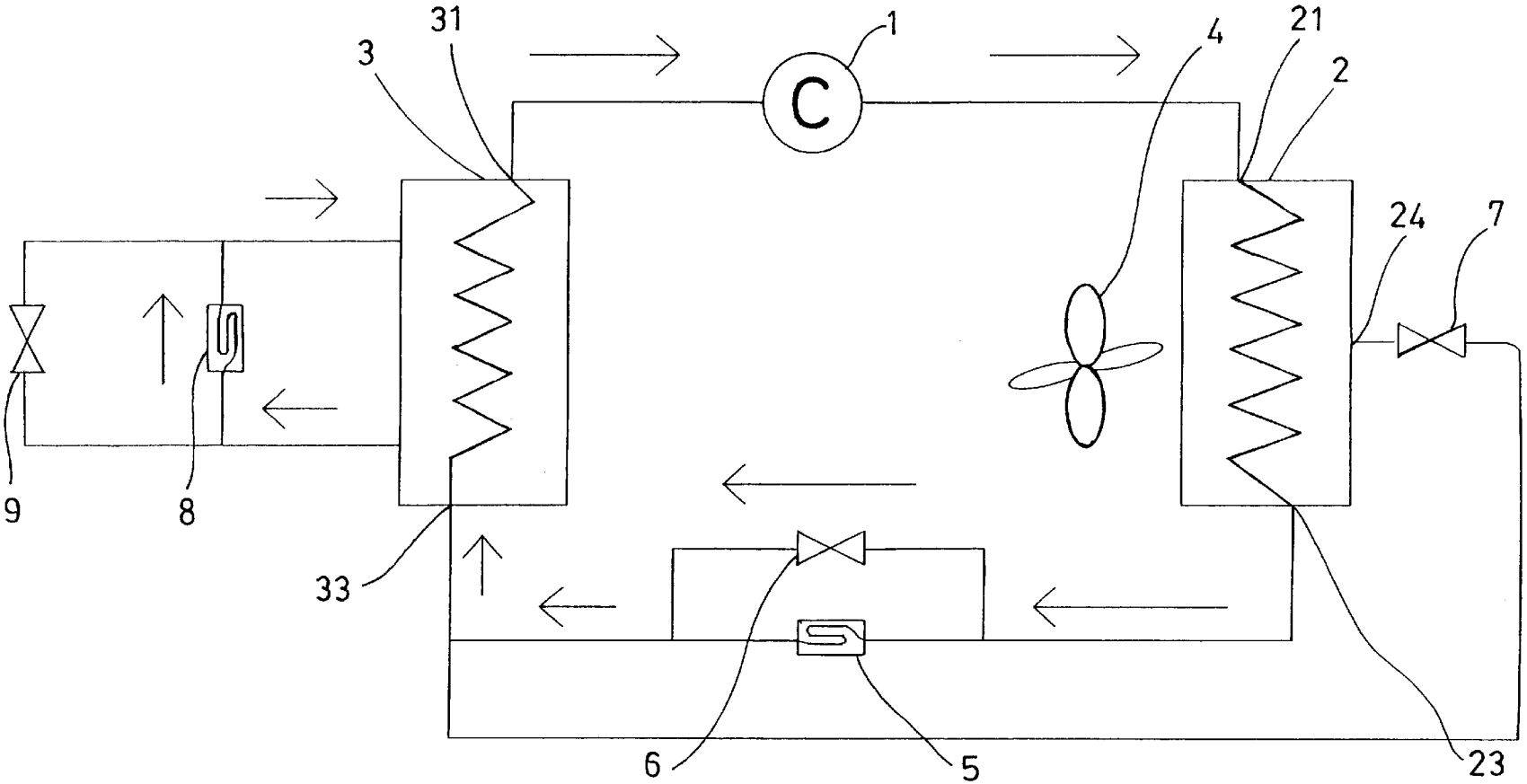
FIG. 3 is a plan schematic view similar to FIGS. 1 and 2, illustrating the micro dehumidifying operation of the air conditioning device.

As shown in FIG. 3, when only the valve device 6 is actuated or energized or operated, and when the other two valve devices 7, 9 are closed or switched off, the heat or cold media may be pumped by the compressor 1, through the condenser 2 and then through the valve device 6 and through the evaporator 3, and may also be pumped through the capillary tube device 8, for dehumidifying or drying purposes. The fan device 4 is preferably operated under decreased rotational speed, at this moment.

Figure 4:
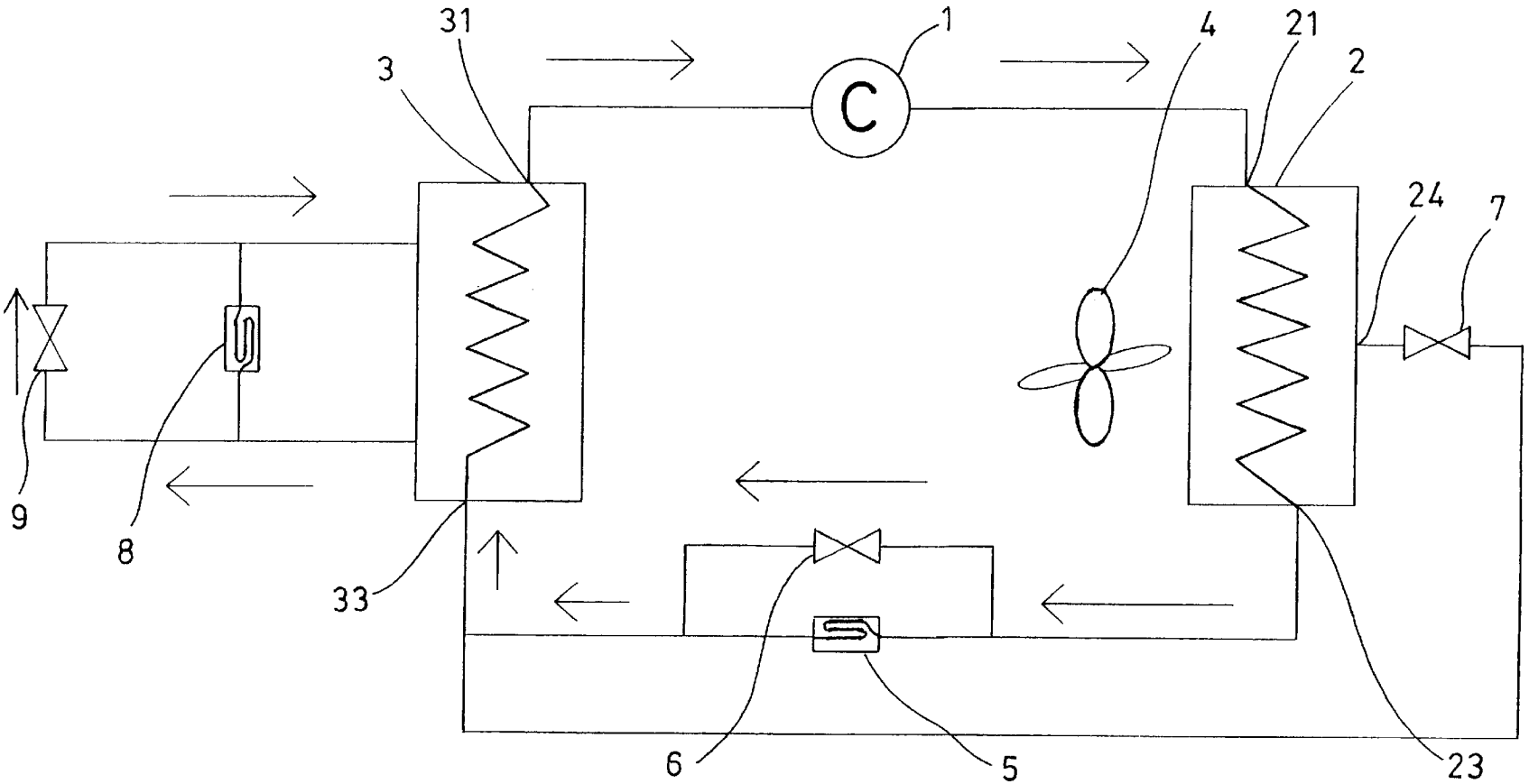
FIG. 4 is a plan schematic view similar to FIGS. 1–3, illustrating the defrosting operation of the air conditioning device.

As shown in FIG. 4, when both the valve devices 6, 9 are actuated or energized or operated, and when the valve device 7 is closed or switched off, the heat or cold media may be pumped by the compressor 1, through the condenser 2 and then through the valve device 6 and through the evaporator 3, and may also be pumped through the valve device 9 without flowing through the capillary tube devices 5, 8, for defrosting purposes.

Accordingly, the air conditioning device in accordance with the present invention includes a compressor, a condenser, an evaporator, two capillary tube devices, and three valves arranged and operated for air conditioning purposes and dehumidifying purposes and for defrosting purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air conditioning device comprising:

a compressor, a condenser coupled to said compressor, an evaporator coupled to said compressor, and arranged to have said compressor coupled between said condenser and said evaporator, a fan device disposed beside said condenser for blowing air through said condenser, a first capillary tube device coupled between said condenser and said evaporator, a first valve device coupled between said condenser and said evaporator, and arranged in parallel to said first capillary tube, a second valve device coupled between said condenser and said evaporator, and arranged in parallel to said first capillary tube and said first valve device, a second capillary tube device coupled in parallel to said evaporator, and a third valve device coupled in parallel to said evaporator, and coupled in parallel to said second capillary tube device, said third valve device being selectively operated, and said first and said second valve devices being selectively switched off for air conditioning purposes, said second valve device being selectively operated, and said first and said third valve devices being selectively switched off for dehumidifying purposes, said first valve device being selectively operated, and said second and said third valve devices being selectively switched off for drying purposes, and said first and said third valve devices being selectively operated, and said second valve device being selectively switched off for defrosting purposes.

2. The air conditioning device as claimed in claim 1, wherein said first valve device is an electromagnetic valve device.

3. The air conditioning device as claimed in claim 1, wherein said second valve device is an electromagnetic valve device.

4. The air conditioning device as claimed in claim 1, wherein said third valve device is an electromagnetic valve device.

5. The air conditioning device as claimed in claim 1, wherein said condenser includes an inlet coupled to said compressor, and said evaporator includes an outlet coupled to said compressor.

6. The air conditioning device as claimed in claim 1, wherein said condenser includes an outlet coupled to said first capillary tube, and said evaporator includes an inlet coupled to said first capillary tube.

7. The air conditioning device as claimed in claim 1, wherein said condenser includes an outlet coupled to said first valve device, and said evaporator includes an inlet coupled to said first valve device.

8. The air conditioning device as claimed in claim 1, wherein said condenser includes a middle portion coupled to said second valve device, and said evaporator includes an inlet coupled to said second valve device.

* * * * *